US008907563B2

(12) United States Patent
Kaps et al.

(10) Patent No.: US 8,907,563 B2
(45) Date of Patent: Dec. 9, 2014

(54) HALOGEN INCANDESCENT LAMP FOR VEHICLE HEADLIGHTS AND VEHICLE HEADLIGHT

(75) Inventors: Harald Kaps, Zusmarshausen (DE); Oliver Woisetschlaeger, Sontheim (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/985,893

(22) PCT Filed: Jan. 20, 2012

(86) PCT No.: PCT/EP2012/050865
§ 371 (c)(1),
(2), (4) Date: Aug. 16, 2013

(87) PCT Pub. No.: WO2012/110277
PCT Pub. Date: Aug. 23, 2012

(65) Prior Publication Data

US 2013/0320844 A1 Dec. 5, 2013

(30) Foreign Application Priority Data

Feb. 17, 2011 (DE) ..... 10 2011 004 290

(51) Int. Cl.
*H01K 1/50* (2006.01)
*H01K 1/14* (2006.01)

(52) U.S. Cl.
CPC ..... *H01K 1/14* (2013.01)
USPC ..... 313/578

(58) Field of Classification Search
CPC ..... H01K 1/28; H01K 1/30; H01K 1/32; H01K 1/36; H01K 1/42; H01K 3/06; H01K 9/08; H01K 1/02; H01K 1/08; H01K 1/14; H01K 1/24; H01K 1/56; H01K 3/22; H01K 5/02; H01K 7/02; H01K 9/00; H01K 1/50; H01K 1/18; H01K 1/325; F21S 48/10; F21S 4/008; F21S 48/1109; F21S 48/1742; F21S 6/003; H01J 65/042; H01J 65/048; H01J 9/20; H01J 9/34; H01J 61/106; H01J 61/025; H01J 61/35; H01J 5/08; H01J 61/30; H01J 61/34; H01J 61/363; H01J 61/40; H01J 61/82; F21V 29/225; F21V 31/03; F21V 5/007; F21V 5/008; F21V 7/0091
See application file for complete search history.

(56) References Cited

U.S. PATENT DOCUMENTS 5,896,007 A 4/1999 Dobiasch et al.

FOREIGN PATENT DOCUMENTS

| | | | |
|---|---|---|---|
| DE | 102010002647 | A1 | 9/2011 |
| JP | 9506996 | A | 7/1997 |
| WO | 2010052140 | A1 | 5/2010 |

OTHER PUBLICATIONS

United Nations Economic Commission for Europe (UNECE), "Uniform Provisions concerning the approval of filament lamps for use in approved lamp units of power-driven vehicles", Category H16 and H16B, Addendum 36, Regulation No. 37, Revision 6; Oct. 3, 2011; pp. 1-189.

(Continued)

*Primary Examiner* — Donald Raleigh

(57) ABSTRACT

A halogen incandescent lamp for vehicle headlamps includes a coiled incandescent filament arranged within a transparent lamp vessel, wherein the incandescent filament is dimensioned in such a way that, during operation on an operating voltage of 13.2 V, the halogen incandescent lamp has an electrical power consumption in the region of greater than 22 watts and less than or equal to 27 watts and generates a luminous flux in the range of from 400 to 600 lumens.

9 Claims, 1 Drawing Sheet

(56) References Cited

OTHER PUBLICATIONS

United Nations Economic Commission for Europe (UNECE), Working Party on Lighting and Light-Signalling, Sixty-third session, "Report of the Working Party on Lighting and Light-Signalling on its sixty-third session" (ECEITRANSIWP.29/GRE/63); Apr. 22, 2010; pp. 1-39.

United Nations Economic Commission for Europe (UNECE), Working Party on Lighting and Light-Signalling, Sixty-third session, "Proposal for Supplement 36 to the 03 series of amendments to Regulation No. 37" (ECEITRANSIWP.29/GRE/201 0/11); Jan. 14, 2010; pp. 1-6.

Expert from IEC, Informal Document No. GRE-63-05 (63rd GRE, Mar. 29-31, 2010, agenda item 3), Proposal for draft Corrigendum 1 to Supplement 34 to the 03 series of amendments to Regulation No. 37; 2 pages.

Expert from IEC, Informal Document No. GRE-63-06 (63rd GRE, Mar. 29-31, 2010, agenda item 3), Proposal to correct document ECEITRANSI WP.29/GRE/2010/11; 1 page.

Office Action issued in the corresponding Japanese application No. 2013-553855, dated Jun. 30, 2013.

HALOGEN INCANDESCENT LAMP FOR VEHICLE HEADLIGHTS AND VEHICLE HEADLIGHT

RELATED APPLICATIONS

The present application is a national stage entry according to 35 U.S.C. §371 of PCT application No.: PCT/EP2012/050865 filed on Jan. 20, 2012, which claims priority from German application No.: 10 2011 004 290.3 filed on Feb. 17, 2011.

TECHNICAL FIELD

Various embodiments relate to a halogen incandescent lamp for vehicle headlamps and vehicle headlamps with such a halogen incandescent lamp.

BACKGROUND

Such a halogen incandescent lamp is disclosed in WO 2007/042464 A1, for example. This specification describes a halogen incandescent lamp for vehicle headlamps including an incandescent filament coil arranged within a transparent lamp vessel. The incandescent filament coil is dimensioned in such a way that, during its operation on the on-board system voltage of the vehicle, the halogen incandescent lamp has an electrical power consumption of approximately 55 watts and generates a luminous flux of approximately 1715 lumens.

SUMMARY

Various embodiments provide an energy-saving halogen incandescent lamp which is versatile for use for different functions in vehicle headlamps.

The halogen incandescent lamp according to the disclosure for vehicle headlamps has a coiled incandescent filament arranged within a transparent lamp vessel, which incandescent filament is dimensioned in such a way that, during operation on an operating voltage of 13.2 V, the halogen incandescent lamp has an electrical power consumption in the region of greater than 22 watts and less than or equal to 27 watts and generates a luminous flux in the range of from 400 to 600 lumens. As a result, the halogen incandescent lamp according to the invention can be used in vehicle headlamps for different functions. For example, the halogen incandescent lamp according to the disclosure can be used for a static or dynamic cornering light or turning light or can, for example, also be operated in a dimmed state in a headlamp which is used for generating the daytime running light or position light. In addition, for example, a plurality of the halogen incandescent lamps according to the disclosure can be used in a vehicle headlamp for generating the upper beam and/or the lower beam. In addition, the halogen incandescent lamp according to the disclosure may also be used as a light source in a reversing lamp. The halogen incandescent lamp according to the invention thus forms a versatile light source for vehicle headlamps owing to the dimensioning of its incandescent filament in accordance with the disclosure.

Preferably, the incandescent filament of the halogen incandescent lamp according to the disclosure has a filament coil body in the form of a single coil and having a turns number in the range of 17 to 23 in order to ensure a light emission which is as homogeneous as possible.

Advantageously, the length of the filament coil body of the incandescent filament of the halogen incandescent lamp according to the disclosure measured along its winding axis is in the range of from 2.1 millimeters to 3.6 millimeters and the outer diameter of the filament coil body of the incandescent filament of the halogen incandescent lamp according to the disclosure is preferably in the range of from 0.9 millimeter to 1.3 millimeters in order to come as close as possible to the ideal for a spot light source for the projection in the headlamp.

The wire thickness of the filament coil wire of the incandescent filament coil of the halogen incandescent lamp according to the disclosure is preferably in the range of from 95 micrometers to 105 micrometers. As a result, the nonreactive resistance of the filament coil may be matched to the operating voltage and the desired electrical power consumption of the halogen incandescent lamp.

In order to reduce the evaporation rate of the filament coil material of the incandescent filament coil and to prevent blackening of the lamp vessel by evaporating filament coil material, advantageously a fill gas is provided in the interior of the lamp vessel of the halogen incandescent lamp according to the disclosure, said fill gas containing, in addition to a halogen fill, a noble gas or a noble gas mixture from the group consisting of xenon, krypton and argon. The coldfilling pressure of the halogen incandescent lamp according to the disclosure is preferably in the range of from 0.7 megapascal to 1.5 megapascals.

The halogen incandescent lamp according to the disclosure preferably has a lamp vessel, which has a circular-cylindrical section surrounding the incandescent filament and having an outer diameter in the range of from 8 millimeters to 10 millimeters in order to ensure sufficient heating of the lamp vessel for the halogen cycle process.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
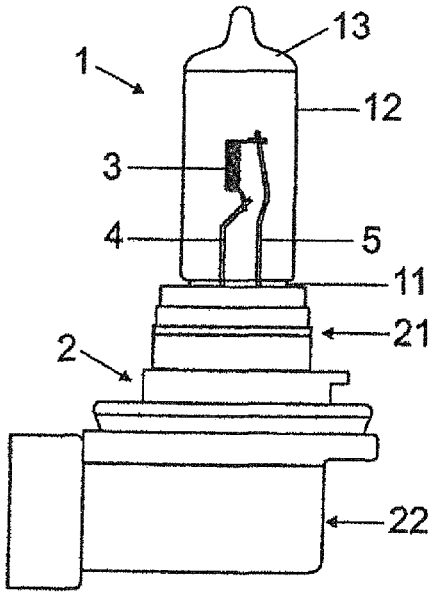
FIG. 1 shows a side view of a halogen incandescent lamp in accordance with the preferred exemplary embodiments of the disclosure in a schematic illustration.

FIG. 1 shows a schematic illustration of the design of a halogen incandescent lamp in accordance with the preferred exemplary embodiments of the disclosure. This halogen incandescent lamp is a halogen incandescent lamp of the type H16.

This halogen incandescent lamp has a lamp vessel 1 consisting of quartz glass or hard glass, for example alum-silicate glass, and which is fixed in the metal base part 21 of a lamp base 2. The plastics base part 22 of the lamp base 2, said plastics base part adjoining the metal base part 21, is equipped with electrical connections (not depicted) for supplying power to the halogen incandescent lamp. The lamp vessel 1, which is closed in a gas-tight manner, has a sealed end 11, which is fixed in the metal base part 21, and a circular-cylindrical central lamp vessel section 12 and a lamp vessel dome 13, which is opposite the sealed end 11 and is provided with an opaque coating. The circular-cylindrical lamp vessel section 12 has an outer diameter of 9 millimeters and a wall thickness of 1.1 millimeters. A fill gas mixture with a cold-filling pressure of approximately 1.2 megapascals and including halogens and krypton is arranged in the interior of the lamp vessel 1. In the region of the circular-cylindrical lamp vessel section 12, an incandescent filament 3 in the form of a tungsten filament coil is arranged within the lamp vessel 1. The winding axis A-A of the filament coil 3 is aligned in parallel with the cylinder axis of the circular-cylindrical lamp vessel section 12. The two ends 31, 32 of the incandescent filament 3 are each enveloped by a molybdenum tube 33, 34 acting as welding aid and are welded to a power supply wire 4 or 5 consisting of molybdenum. The power supply wires 4, 5 are passed out of the sealed end 11 of the lamp vessel 1 and connected to the electrical connections of the halogen incandescent lamp.

Figure 2:
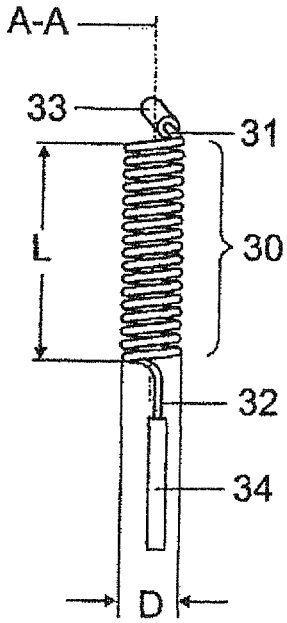
FIG. 2 shows an enlarged illustration of the incandescent filament of the halogen incandescent lamp depicted in FIG. 1.

FIG. 2 shows a schematic illustration of details of the incandescent filament 3. The incandescent filament 3 is in the form of an incandescent filament coil with a single coil. It has a filament coil body 30 in the form of a single coil and has two uncoiled ends 31, 32. The uncoiled ends 31, 32 are each surrounded by a molybdenum tube 33, 34 or wrapped with a molybdenum foil, which molybdenum tube or molybdenum foil acts as welding aid when welding the ends 31, 32 of the incandescent filament 3 to the power supply wires 4, 5. The length L of the filament coil body 30 measured along its winding axis A-A is 3.2 millimeters. The outer diameter D of the filament coil body 30 or of the turns of the coil body 30 is 1.1 millimeters. The filament coil body has 19 turns, i.e. the turns number W of the incandescent filament 3 is 19. The diameter of the tungsten wire used for making the incandescent filament 3 is 100 micrometers. During operation on a rated on-board system voltage of 13.2 volts with this incandescent filament, the halogen incandescent lamp has an electrical power consumption of 25.4 watts and generates a luminous flux of 470 lumens.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A halogen incandescent lamp for vehicle headlamps comprising a coiled incandescent filament arranged within a transparent lamp vessel, wherein the incandescent filament is dimensioned in such a way that, during operation on an operating voltage of 13.2 V, the halogen incandescent lamp has an electrical power consumption in the region of greater than 22 watts and less than or equal to 27 watts and generates a luminous flux in the range of from 400 to 600 lumens.

2. The halogen incandescent lamp as claimed in claim 1, wherein the incandescent filament has a filament coil body in the form of a single coil and having a turns number W in the range of 17 to 23.

3. The halogen incandescent lamp as claimed in claim 1, wherein the diameter of the incandescent filament wire is in the range of from 95 micrometers to 105 micrometers.

4. The halogen incandescent lamp as claimed in claim 2, wherein the length of the filament coil body measured along its winding axis is in the range of from 2.1 millimeters to 3.6 millimeters.

5. The halogen incandescent lamp as claimed in claim 2, wherein the outer diameter of the filament coil body is in the range of from 0.9 millimeter to 1.3 millimeters.

6. The halogen incandescent lamp as claimed in claim 1, wherein the interior of the lamp vessel is filled with gas which contains a noble gas.

7. The halogen incandescent lamp as claimed in claim 1, wherein the lamp vessel has a circular-cylindrical section in the region of the incandescent filament, the outer diameter of said circular-cylindrical section being in the range of from 8 millimeters to 10 millimeters.

8. A vehicle headlamp comprising at least one halogen incandescent lamp comprising a coiled incandescent filament arranged within a transparent lamp vessel, wherein the incandescent filament is dimensioned in such a way that, during operation on an operating voltage of 13.2 V, the halogen incandescent lamp has an electrical power consumption in the region of greater than 22 watts and less than or equal to 27 watts and generates a luminous flux in the range of from 400 to 600 lumens.

9. The halogen incandescent lamp as claimed in claim 1, wherein the interior of the lamp vessel is filled with gas which contains a noble gas mixture from the group consisting of xenon, krypton and argon and also halogens.

* * * * *